US005718563A

United States Patent [19]

Hutchinson

[11] Patent Number: 5,718,563

[45] Date of Patent: Feb. 17, 1998

[54] PORTABLE COMPRESSOR WITH SYSTEM FOR OPTIMIZING TEMPERATURE IN COMPRESSOR HOUSING AND METHOD

[75] Inventor: William Roger Hutchinson, Clemmons, N.C.

[73] Assignee: Ingersoll-Rand Company, Woodcliff Lake, N.J.

[21] Appl. No.: 724,880

[22] Filed: Oct. 3, 1996

[51] Int. Cl.[6] ..... F04B 49/10

[52] U.S. Cl. ..... 417/32; 417/243; 417/372; 165/97; 165/299

[58] Field of Search ..... 417/32, 243, 372, 417/292, 53; 165/97, 299

[56] References Cited

U.S. PATENT DOCUMENTS

| | | | |
|---|---|---|---|
| 2,776,117 | 1/1957 | Davis . | |
| 3,941,185 | 3/1976 | Henning . | |
| 4,373,576 | 2/1983 | Strupczewski . | |
| 4,422,498 | 12/1983 | Chen | 165/47 |
| 5,215,834 | 6/1993 | Reher et al. . | |
| 5,284,202 | 2/1994 | Dickey et al. . | |
| 5,287,916 | 2/1994 | Miller . | |
| 5,310,020 | 5/1994 | Martin et al. | 184/6.3 |
| 5,362,207 | 11/1994 | Martin et al. | 417/243 |
| 5,386,873 | 2/1995 | Harden, III et al. | 417/243 |
| 5,507,618 | 4/1996 | Kubo et al. | 417/372 |

*Primary Examiner*—Timothy Thorpe
*Assistant Examiner*—Xuan M. Thai
*Attorney, Agent, or Firm*—Michael M. Gnibus

[57] ABSTRACT

A portable compressor, which includes a compressor airend for compressing a fluid; a prime mover operably connected to the airend to drive the airend and thereby compress the fluid; and a portable compressor housing which defines a housing chamber having a chamber temperature. The compressor means and prime mover are located in the chamber. The housing has a first end and a second end and means formed thereon to provide for ambient air to flow through the first and second ends and into the housing chamber. The portable compressor also including a housing chamber temperature optimizing system comprising: fan for drawing ambient air through the housing ends. The fan is adapted for movement in a first direction to draw ambient air through the first housing end and in a second direction to draw ambient air through the second housing end. The system also includes a chamber temperature measuring member located in the housing chamber; and a motor for moving the fan. The motor is operably connected to the fan and is also in signal receiving relationship with the temperature measuring member. The motor is adapted to move the fan in a first direction to draw ambient air through the first housing end when the housing chamber temperature is above a set point temperature, and to move the fan in a second direction to draw ambient air through the second housing end when the housing chamber temperature is below a set point temperature.

11 Claims, 2 Drawing Sheets

PORTABLE COMPRESSOR WITH SYSTEM FOR OPTIMIZING TEMPERATURE IN COMPRESSOR HOUSING AND METHOD

FIELD OF THE INVENTION

This invention generally relates to a system and method for optimizing the temperature in a portable compressor housing chamber, and more particularly to a system and method for optimizing the housing chamber temperature where ambient air is drawn into the housing chamber in a first direction when the measured chamber temperature is above a predetermined set point temperature and where ambient air is drawn into the housing in a second direction when the measured chamber temperature is below the predetermined set point temperature.

DESCRIPTION OF THE PRIOR ART

Unlike stationary compressors which are typically permanently located and used indoors, in a temperature controlled environment such as in a manufacturing plant, factory or garage; portable compressor units, because they are easily transportable, are moved between locations where use of the portable compressor is required. As a result, portable compressors are used outdoors or in another location where ambient conditions are variable.

It is common for a portable compressor to be operated in extremely hot and cold ambient conditions such as at a highway construction site or at a ski slope for example. Operating portable compressors in extremely hot or cold weather conditions can negatively affect the efficiency of the portable compressor, and may, over time, cause damage to compressor component parts.

When portable compressors are operated in cold ambient conditions with associated low temperatures, the temperature in the compressor housing chamber where the compressor is located is also low. Moisture that is collected in the prime mover fuel lines or in the compressor regulator system may freeze and thereby significantly, negatively affect the operation and efficiency of the compressor. Additionally, compressor component parts that are susceptible to cold weather such as the battery for the compressor prime mover, the compressor airend and plastic and rubber component parts such as mounts, will likely be negatively affected and damaged by the low housing chamber temperatures.

Conversely, when the portable compressor is operated in extremely hot ambient conditions, the temperature in the compressor housing chamber is frequently higher than the already high ambient temperature. The hot chamber temperatures can negatively affect the operation of the compressor and damage heat-sensitive compressor component parts. Additionally, since the compressor component parts get very hot when the unit is operating in hot weather, if the hot compressor requires service, a service technician must wait for a significant period of time after the compressor has been shut down before the compressor has cooled sufficiently so that the parts can be safely handled. As a result, compressor down time may be quite extensive.

Accordingly, it would be desirable to develop a system and method for optimizing the housing chamber temperature by increasing the temperature in the portable compressor housing during portable compressor operation in cold ambient conditions, and lowering the temperature in the portable compressor housing during compressor operation in hot ambient conditions.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a portable compressor comprising a compressor airend for compressing a fluid; a prime mover operably connected to the airend to drive the airend and thereby compress the fluid; and a portable compressor housing which defines a housing chamber having a chamber temperature. The compressor airend and prime mover are located in the chamber. The housing has a first end and a second end and means formed thereon to provide for ambient air to flow through the first and second ends and into the housing chamber. The portable compressor also includes a housing chamber temperature optimizing system comprising: fan for drawing ambient air through the housing ends. The fan is adapted for movement in first and second directions; a chamber temperature measuring member located in the housing chamber; and a motor for moving the fan. The motor is operably connected to the fan and is also in signal receiving relationship with the temperature measuring member. The motor is adapted to move the fan in the first direction to draw ambient air through the first housing end when the housing chamber temperature is above a set point temperature, and to move the fan in the second direction to draw ambient air through the second housing end when the housing chamber temperature is below a set point temperature.

The foregoing and other aspects will become apparent from the following detailed description of the invention when considered in conjunction with the accompanying drawing figures.

BRIEF DESCRIPTION OF THE DRAWING FIGURES

FIG. 1 is a schematic representation of a portable compressor that includes a first embodiment system for optimizing temperature in a portable compressor housing;

FIG. 2 is a schematic representation of the portable compressor of FIG. 1 that includes a second embodiment of the system for optimizing temperature in the portable compressor housing; and FIG. 3 is a schematic representation of an electronically controlled system for optimizing portable compressor housing temperature which may be used in the first and second embodiment portable compressors shown schematically in FIGS. 1 and 2.

DETAILED DESCRIPTION OF THE PREFERRED EMBODIMENT

Figure 1:
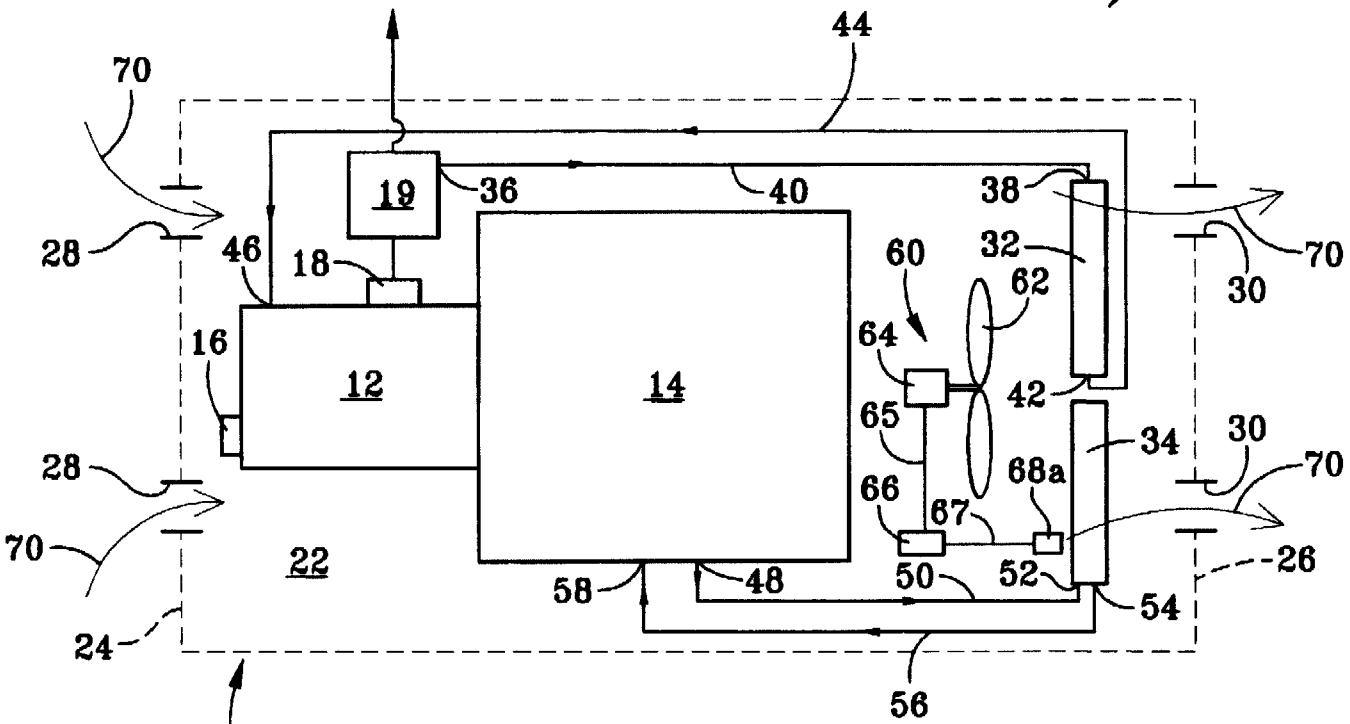

Referring now to the drawings, wherein similar reference characters designate corresponding parts throughout the several views, and specifically to FIG. 1 which shows a portable compressor generally indicated at 10. The portable compressor 10 includes many of the features and components of conventional portable compressors known to one skilled in the art including the portable compressor shown and described in U.S. Pat. No. 5,362,207 which is incorporated herein by specific reference.

Portable compressor 10 includes compressor or airend 12 that is driven by a prime mover 14. The compressor 12 may be comprised of any compressor known to one skilled in the pertinent art such a rotary screw compressor or a centrifugal compressor for example. The prime mover 14 may be any suitable prime mover adapted to drive compressor 12, including a diesel engine or any internal combustion engine.

The compressor 12 includes an inlet 16 for flowing a fluid such as air into the compressor compression chamber (not shown), and an outlet or discharge port 18 for flowing the compressed fluid to a pneumatic tool or other object of interest.

Figure 2:
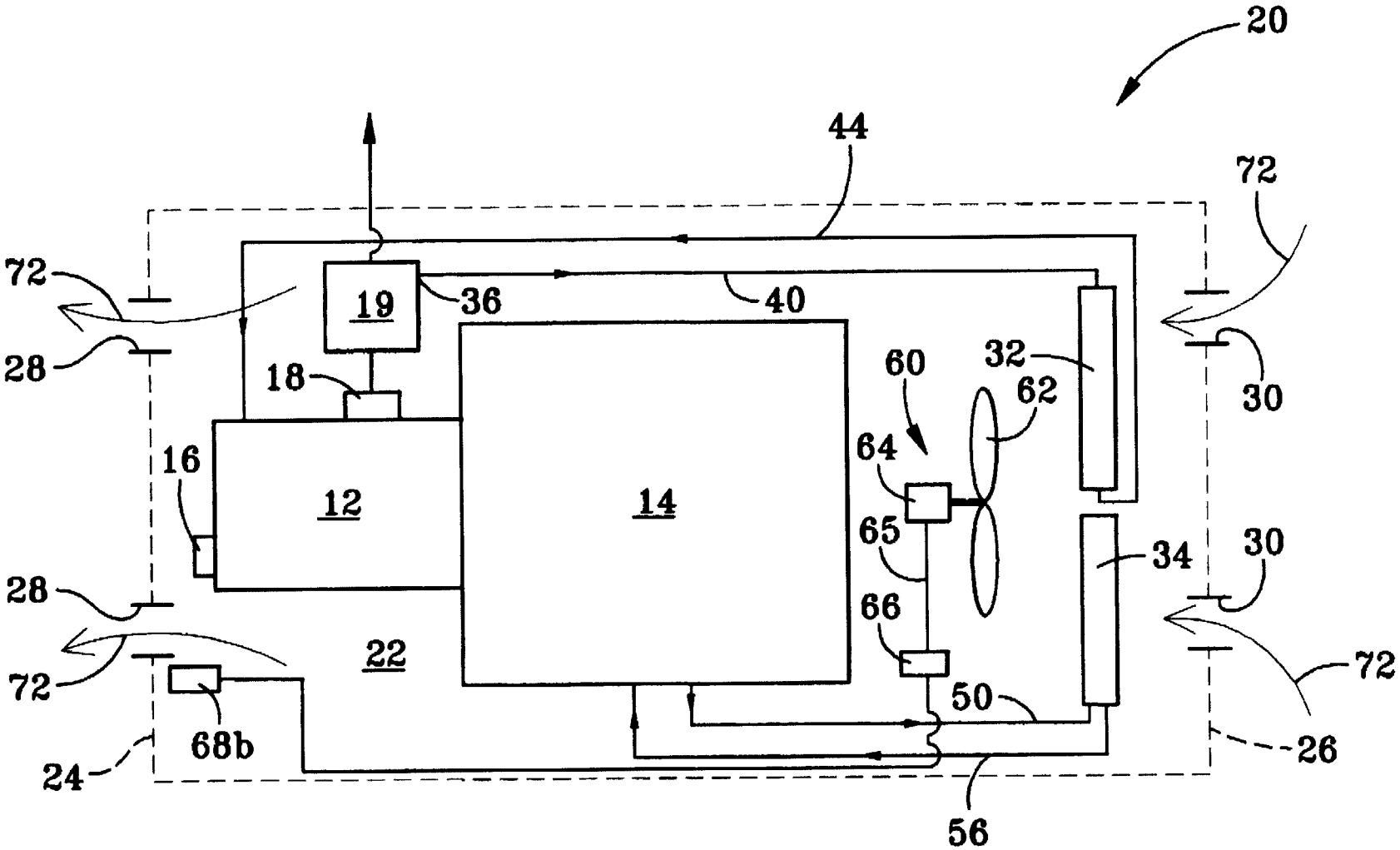

The compressor 12 and prime mover 14 are located in a chamber 22 that is defined by portable compressor housing 20 that protects the components of the portable compressor during operation and transportation. The housing includes a first housing end 24 and a second housing end 26, first housing openings 28 provided along the first housing end, and second housing openings 30 provided in the second housing end. The first and second housing openings may be comprised of any suitable shape including, one or more slots or a mesh screen. In FIGS. 1 and 2, the openings 28 and 30 are shown schematically and are relatively large however, the openings should be covered defined by the screen or slots should be relatively small so that debris or other large particulate matter is prevented from being entrained with ambient air and flowing into chamber 22 during operation of portable compressor 10.

Oil cooler 32 and prime mover coolant cooler 34 are located in chamber 22 near second housing end 26. The oil cooler cools lubricant that is mixed with the compressible fluid in the compressor compression chamber during operation of compressor 12. The mixture of oil and compressed fluid is flowed into separator unit 19. The hot oil is separated from the fluid by the conventional separator unit 19. The separated oil is flowed out separator oil discharge port 36 to cooler inlet 38 through conduit 40 that flow connects port 36 and inlet 38. The cooler cools the oil in a manner well known in the art and the cooled oil is flowed from cooler 32 out cooler discharge port 42, through flow conduit 44 and is reinjected into compressor 12 through oil inlet 46. Conduit 44 flow connects discharge port 42 and compressor inlet 46.

Coolant for cooling prime mover 14 is cooled by cooler 34. The hot coolant is flowed from prime mover discharge port 48, through coolant flow conduit 50, and into cooler 34 through inlet 52. The coolant is cooled and is flowed back to prime mover 14 out cooler discharge port 54, through flow conduit 56 and is injected back into the prime mover through inlet 58. As shown in FIG. 1, flow conduits 50 and 56 respectively flow connect ports 48, 52, and 54, 58.

Portable compressor 10 includes a system for optimizing the temperature in chamber 22 during operation of portable compressor 10 to increase the operating efficiency of the portable compressor and also prevent damage to temperature sensitive compressor components. The system lowers the chamber temperature when the compressor is operated in hot environments and increases the chamber temperature when the compressor is operated in cold environments. The system is generally indicated at 60 in FIG. 1.

The system 60 includes a fan 62 or other means for drawing ambient air into the portable compressor housing chamber 22. A fan is shown in order to describe the first preferred embodiment of the invention however, it should be understood that any suitable means for drawing ambient air into the housing chamber 22 may be used. Like fan 62, such a suitable means for drawing ambient air into chamber 22 must be adapted to move in a first direction and a second direction and thereby draw ambient air into the housing chamber in different directions. For purposes of describing the first preferred embodiment of the invention, the fan 62 is a conventional axial flow propeller.

The fan is operatively connected to drive means 64 which is a conventional DC-type electric motor. Drive means 64 operates in a manner well known to one skilled in the art. Drive means 64 is made to rotate in first and second directions by reversing or otherwise altering the polarity of the motor. Although a DC-type electric motor is shown and described, any suitable drive means adapted to be rotated or otherwise moved in more than one direction may be used to drive fan 62 in more than one direction. In this way, ambient air may be drawn through the housing chamber in different directions.

The motor 62 is electrically connected to a conventional relay 66 by electrical connection 65 and the relay is in turn electrically connected to a temperature switch 68 by electrical connection 67. The temperature switch and electrical connections are well known to one skilled in the art.

The temperature switch is located in chamber 22 adjacent cooler 34 near second housing end 26 as shown in FIG. 1. The temperature switch may be located at any location in the chamber. However the switch should be located in the chamber where a beneficial, representative chamber temperature measurement may be made. In the first embodiment portable compressor 10, a beneficial, representative chamber temperature measurement is made adjacent cooler 34.

Now turning to the second embodiment of the present invention shown in FIG. 2, the beneficial location to measure the temperature in chamber 22 is at the first housing end 24. In FIG. 2, the temperature switch is identified generally as **68*b*. All of the other components comprising portable compressor 80 are the same as previously described in the foregoing description of first embodiment portable compressor 10**, and therefore are identified by the same reference characters.

In each embodiment portable compressor 10 and 80, the temperature switch **68*a*, 68*b* is provided with a predetermined acceptable set point temperature. When the portable compressor is operated in an environment with high ambient temperatures, and as a result, the temperature in the housing chamber 22 is above the set point temperature, the DC motor 64 rotates in a first direction and causes the fan 62 to likewise rotate in a first direction. Ambient air is drawn through the first openings 28 provided in the first housing end 24 by the movement of the fan. The first flow direction is represented generally by directional arrows 70 in FIG. 1. Before the ambient air is drawn into the chamber, each of the compressor components has a high temperature. The ambient air which is cooler than the air in the chamber housing 22** flows through the chamber and across the compressor components, and decreases the high temperatures of the compressor components.

When the portable compressors 10 and 80 are operated in a relatively cold environment where the ambient temperatures are low, and temperature in the housing chamber 22 is below the predetermined set point, the temperature switch activates and causes the relay to reverse the polarity of the motor 64, thereby causing the motor and fan to rotate in a second direction, opposite the first direction. Before the air is flowed into the compressor each of the parts has a low temperature. Ambient air is drawn into the housing chamber through the second openings 30 in second end 26 of the compressor housing 20 and through coolers 32 and 34. The coolers warm the cool ambient air and the warmed air flows out the coolers and is flowed across the compressor component parts. As the warm air passes over the compressor component parts, the low temperatures of the components are increased. The warm air then flows out the housing through openings 28 in the first housing end. Ambient air generally flows through the compressor chamber 22 in the direction represented by arrows 72 in FIG. 2.

If the portable compressors are moved to a hot environment and the temperature in the chamber 22 is measured to be above a set point temperature, the temperature switch activates and causes the relay to reverse the polarity of the motor, thereby causing the motor to again rotate in the first direction in the manner previously described.

Although the first flow direction is shown on FIG. 1 and the second flow direction is shown on FIG. 2, it should be understood that compressors 10 and 80 are adapted to provide airflow in both the first and second directions by utilizing temperature optimizing system 60.

By system 60 the compressor operating temperature in housing chamber 22 is optimized by reversing the direction of ambient airflow through the portable compressor housing chamber. The low temperatures of the compressor components are increased when the compressor is operated in cold environments and is cooled when it is operated in very warm climates. Accordingly, the efficiency of the compressor is increased and the useful life of the compressor components is extended.

Figure 3:
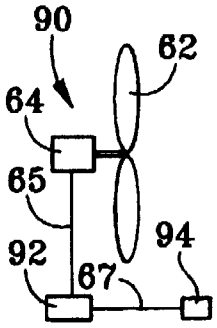

FIG. 3 shows housing chamber temperature optimizing system 90 which is like system 60 except relay 66 and switches 68*a*, 68*b* are replaced by electric circuit 92 and temperature sensor 94 respectively. Temperature switches 68*a* and 68*b* may be replaced by suitable conventional temperature sensor 94 located in substantially the same positions in chamber 22 as switches 68*a* and 68*b*. The sensor is a conventional temperature sensor known to one skilled in the art and transmits output signals representative of the temperature measured by the sensor.

The relay 66 is replaced by an electronic circuit. The circuit is electrically connected in signal transmitting relation with the motor 64 and in signal receiving relation with sensor 94. The circuit is programmed in a conventional manner with an algorithm which compares the signal received from the sensor with a signal representing a predetermined set point temperature to determine whether the sensed temperature is above or below the predetermined set point temperature.

In operation, the output signal from the sensor is fed to the electronic circuit which processes the signal and compares the output signal to the stored signal representing the set point temperature. As a result of this comparison, the circuit alters the polarity of the motor 64 to reverse the direction of rotation of the motor and fan. Ambient air is drawn through the chamber housing 22 in the manner previously described hereinabove.

While I have illustrated and described a preferred embodiment of our invention, it is understood that this is capable of modification, and I therefore do not wish to be limited to the precise details set forth, but desire to avail myself of such changes and alterations as fall within the purview of the following claims.

Having described the invention, what is claimed is:

1. A portable compressor, comprising:

a) compressor means for compressing a fluid;

b) prime mover means operably connected to the compressor means to drive the compressor means and thereby compress the fluid;

c) a portable compressor housing which defines a housing chamber having a chamber temperature, the compressor means and prime mover being located in the chamber, said housing having a first end and a second end and means formed thereon to provide for ambient air to flow through the first and second ends and into the housing chamber; and d) a housing chamber temperature optimizing system comprising:

i) flow means for drawing ambient air through the housing ends, said flow means adapted for movement in a first direction to draw ambient air through the first housing end and in a second direction for drawing ambient air through the second housing end;

ii) measuring means located in the housing chamber, said measuring means for measuring the temperature in the housing chamber; and iii) drive means for moving the flow means, said drive means being operably connected to said flow means and also being in signal receiving relationship with the measuring means, said drive means adapted to move the flow means in a first direction to draw ambient air through the first housing end when the housing chamber temperature is at a set point temperature, and to move the flow means in a second direction to draw ambient air through the second housing end when the housing chamber temperature is below a set point temperature.

2. The portable compressor as claimed in claim 1 wherein said measuring means is comprised of a temperature sensor in signal transmitting relation with an electric circuit the electric circuit being connected to the drive means to cause the drive means to move the flow means in the required direction.

3. The portable compressor as claimed in claim 1 wherein the measuring means is comprised of a temperature switch connected to a relay, where the relay is connected to the drive means to cause the drive means to move the flow means in the required direction.

4. The portable compressor as claimed in claim 2 wherein the portable compressor includes a cooler at said second housing end, and said temperature sensor is located near said cooler.

5. The portable compressor as claimed in claim 2 wherein said temperature sensor is located at said first housing end.

6. The portable compressor as claimed in claim 3 wherein the portable compressor includes a cooler at said second housing end, and said temperature switch is located near said cooler.

7. The portable compressor as claimed in claim 3 wherein said temperature switch is located at said first housing end.

8. The portable compressor as claimed in claim 1 wherein said motor is a DC motor and said flow means is an axial flow fan.

9. In a portable compressor which is comprised of compressor component parts enclosed by a portable compressor housing which defines a compressor chamber having a chamber temperature, the housing having a first end and a second end, the portable compressor including a system for optimizing the chamber temperature, said system comprising a flow means for drawing ambient air through the ends of the housing, drive means for driving the flow means in first and second directions, and measuring means for measuring the chamber temperature; a method for optimizing the chamber temperature; said method comprising the steps of:

a) measuring the chamber temperature;

b) comparing the measured temperature to a predetermined chamber set point temperature;

c) actuating the drive means and flow means in a first direction thereby drawing ambient air through a first end of the compressor housing if the chamber temperature is above the set point temperature, and actuating the drive means and flow means in a second direction thereby drawing the ambient air through the second housing end if the chamber temperature is below the set point temperature.

10. The method as claimed in claim 9 wherein said drive means is a DC motor having a polarity, said method comprising the further step of reversing the polarity of the motor to reverse the direction of movement of the motor after step c).

11. The method as claimed in claim 9 wherein said method comprising the step of locating the measuring means in the housing chamber before step a).

* * * * *